US011421494B1

(12) United States Patent
Al Bayat et al.

(10) Patent No.: US 11,421,494 B1
(45) Date of Patent: Aug. 23, 2022

(54) FILTER TOOLS AND METHODS OF FILTERING A DRILLING FLUID

(71) Applicant: Saudi Arabian Oil Company, Dhahran (SA)

(72) Inventors: Ahmed Haider Al Bayat, Saihat (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/215,322

(22) Filed: Mar. 29, 2021

(51) Int. Cl.
*E21B 27/00* (2006.01)
*E21B 7/04* (2006.01)

(52) U.S. Cl.
CPC ..... *E21B 27/005* (2013.01); *E21B 7/04* (2013.01)

(58) Field of Classification Search
CPC ..... E21B 27/005; E21B 37/08; E21B 21/01
See application file for complete search history.

(56) References Cited

U.S. PATENT DOCUMENTS 2,397,199 A * 3/1946 Orr ..... E21B 37/08 166/143
3,023,810 A * 3/1962 Anderson ..... E21B 27/005 166/227
3,123,157 A * 3/1964 Graham ..... E21B 27/005 175/312
4,495,073 A * 1/1985 Beimgraben ..... E21B 21/002 166/227
4,857,175 A 8/1989 Spinnler
6,423,215 B1 * 7/2002 Stein ..... B01D 35/147 210/90
6,598,685 B1 * 7/2003 Mashburn ..... E21B 27/005 166/227
7,188,687 B2 3/2007 Rudd et al.
7,243,740 B2 7/2007 Frith
8,028,768 B2 10/2011 Hall et al.
(Continued)

FOREIGN PATENT DOCUMENTS

CN 106121590 B 5/2018
CN 208992297 U 6/2019
(Continued)

OTHER PUBLICATIONS

International Search Report and Written Opinion dated Nov. 24, 2021 pertaining to International application No. PCT/US2021/028568 filed Apr. 22, 2021, 14 pages.

*Primary Examiner* — Blake Michener
(74) *Attorney, Agent, or Firm* — Dinsmore & Shohl LLP

(57) ABSTRACT

A filter tool for a wellbore may include an outer housing, a filtration system, at least one filter tool sensor, and a filter motor. The outer housing may have an interior wall comprising at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The interior wall of the outer housing and the filtration system may cooperate to define a collection chamber. The filter motor may move the exterior wall of the outer housing between the first position and the second position. Embodiments also include systems and methods employing the filter tool.

20 Claims, 4 Drawing Sheets

(56) References Cited

U.S. PATENT DOCUMENTS

| | | | | |
|---|---|---|---|---|
| 8,501,012 | B2 * | 8/2013 | Himmel | B01D 35/02 166/177.5 |
| 9,228,414 | B2 * | 1/2016 | Xu | E21B 34/14 |
| 9,550,136 | B2 * | 1/2017 | Carpenter | B01D 35/147 |
| 9,784,057 | B2 | 10/2017 | Lloyd et al. | |
| 10,596,496 | B2 | 3/2020 | Sehsah et al. | |
| 2005/0109503 | A1 * | 5/2005 | Kutryk | E21B 21/002 166/227 |
| 2006/0065443 | A1 * | 3/2006 | Hall | E21B 21/002 166/228 |
| 2009/0200012 | A1 * | 8/2009 | Davis | E21B 27/005 166/99 |
| 2009/0272539 | A1 | 11/2009 | Lloyd et al. | |
| 2009/0283330 | A1 * | 11/2009 | Lynde | E21B 27/005 175/316 |
| 2010/0258289 | A1 * | 10/2010 | Lynde | E21B 23/14 166/55.7 |
| 2014/0360725 | A1 * | 12/2014 | Xu | E21B 37/08 166/99 |
| 2018/0015395 | A1 * | 1/2018 | Prost | B01D 35/147 |
| 2018/0291706 | A1 * | 10/2018 | Kehoe | E21B 37/00 |
| 2018/0320492 | A1 | 11/2018 | Shen et al. | |
| 2021/0363839 | A1 * | 11/2021 | Al-Mousa | B01D 33/17 |

FOREIGN PATENT DOCUMENTS

| | | | |
|---|---|---|---|
| CN | 111021969 | A | 4/2020 |
| RU | 2440482 | C1 | 1/2012 |
| RU | 2672074 | C1 | 11/2018 |

* cited by examiner

FILTER TOOLS AND METHODS OF FILTERING A DRILLING FLUID

BACKGROUND

The present disclosure generally relates to drilling tools and more specifically to tools, systems, and methods for filtering a drilling fluid.

BRIEF SUMMARY

Drilling operations are performed with several downhole components. Some of these downhole components—such as those used for measurements while drilling (MWD), rotary steerable systems (RSS), and logging while drilling (LWD)—may use a drilling fluid being passed through the drillstring as a transmitter of data. When the drilling fluid being circulated through the drillstring and wellbore reaches the surface, a computer will analyze the data that is being transmitted from the downhole components. The drilling fluid may also aid to drill through the formation by providing a hydrostatic pressure to prevent formation fluid from entering the wellbore. Further, the drilling fluid may help carry cuttings out of the wellbore while drilling. To satisfy these various purposes, chemicals and solids may be used to help increase or decrease the density of the drilling fluid.

One of the major problems encountered during drilling operations includes losing communication with downhole components. As solids used in the drilling fluid accumulate on sensitive parts in the downhole components, communication may be lost with said downhole components. As a result, the entire drill string may need to be removed from the wellbore to replace one or more downhole components. Accordingly, there is an ongoing need for tools, systems, and methods for filtering a drilling fluid such that communication is not lost with downhole components.

According to one embodiment of the present disclosure, a filter tool for a wellbore may include an outer housing, a filtration system, at least one filter tool sensor, and a filter motor. The outer housing may have an interior wall comprising at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The interior wall of the outer housing and the filtration system may cooperate to define a collection chamber, the filtration system may include at least one screen to allow a drilling fluid being circulated through the wellbore to pass through the filter tool while filtering material from the drilling fluid and collecting material in the collection chamber. The at least one filter tool sensor may measure an amount of material collected in the collection chamber. The filter motor may move the exterior wall of the outer housing between the first position and the second position.

In accordance with another embodiment of the present disclosure, a system for filtering a drilling fluid in a wellbore may include a drilling tool and a filter tool. The drilling tool may include a drilling fluid source, a drill string, and a drill bit. The drilling tool may comprise a length and the drill bit may define a downhole end of the length of the drilling tool. The drilling fluid source may be operable to store a drilling fluid. The drill string may comprise a drilling tool longitudinal axial mandrel extending the length of the drill string. The drill string may couple the drilling fluid source to the drill bit and may transport the drilling fluid stored in the drilling fluid source along the drilling tool longitudinal axial mandrel to the drill bit. The filter tool may include an outer housing, a filtration system, at least one filter tool sensor, and a filter tool motor. The outer housing may include an interior wall having at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The interior wall of the outer housing and the filtration system may cooperate to define a collection chamber. The filtration system may include at least one screen to allow a drilling fluid to pass through the filter tool while filtering material from the drilling fluid and collecting material in the collection chamber. The at least one filter tool sensor may measure the amount of material collected in the collection chamber. The filter motor may move the exterior wall of the outer housing between the first position and the second position. The filter tool may be positioned along the drill string and above the drill bit. The drilling tool longitudinal axial mandrel may be in fluid communication with the filter tool.

In accordance with yet another embodiment of the present disclosure, a method of filtering a drilling fluid in a wellbore may include circulating a drilling fluid through a filter tool in the wellbore. The filter tool may include an outer housing having an interior wall comprising at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The method may also include passing at least a portion of the drilling fluid through a filtration system of the filter tool. The interior wall of the outer housing and the filtration system may cooperate to define a collection chamber. The filtration system may include at least one screen to allow the drilling fluid to pass through the filter tool while filtering material from the drilling fluid and collecting material in the collection chamber. The method may also include measuring an amount of material collected in the collection chamber, moving the exterior wall of the outer housing of the filter tool from the first position to the second position to uncover the at least one port of the interior wall of the housing, and at least partially passing material collected in the collection chamber to the wellbore.

Although the concepts of the present disclosure are described herein with primary reference to a petroleum exploration environment, it is contemplated that the concepts will enjoy applicability to any drilling environment. For example, and not by way of limitation, it is contemplated that the concepts of the present disclosure will enjoy applicability to any environment where drilling into a subsurface formation is required such as, but not limited to, drilling for a foundation or drilling for any other fluid aside from petroleum.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure is directed to tools, systems, and methods for filtering a drilling fluid such that communication is not lost with downhole components. Embodiments of the present disclosure meet this need by providing a filter tool and methods of using the same wherein the filter tool can be emptied during use without being removed from the wellbore. Conventional filter tools do not allow for cleaning or emptying of the filter while the filter is downhole. Thus, there is guesswork as to whether conventional filter tools are full or not. If conventional filter tools are full, they must be removed from the wellbore to be cleaned. Removing the conventional filter tool and drill string from the wellbore puts the well out of operation for a substantial period of time, such as up to multiple days. Embodiments of the present disclosure, as further described herein, avoid the need for guesswork and can continue to filter the drilling fluid while largely reducing the risk of losing communication with downhole components.

Figure 1:
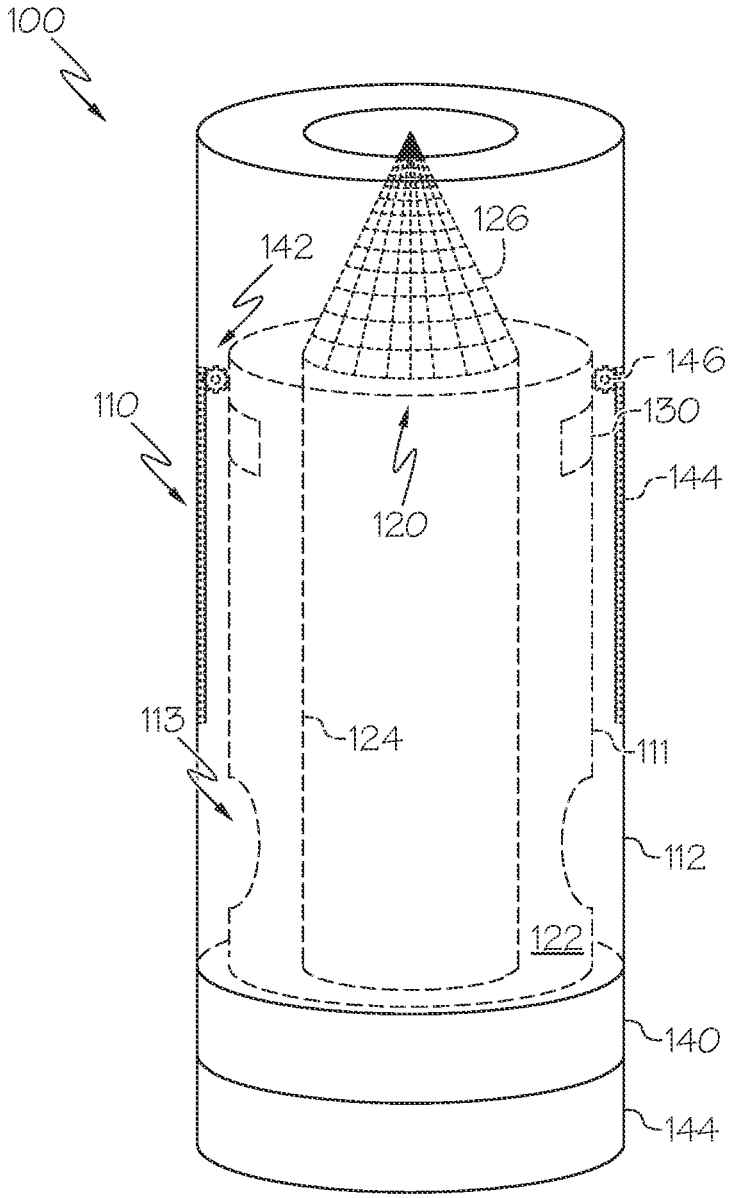
FIG. 1 schematically depicts a filter tool in a first position in accordance with one or more embodiments of the present disclosure.
Figure 2:
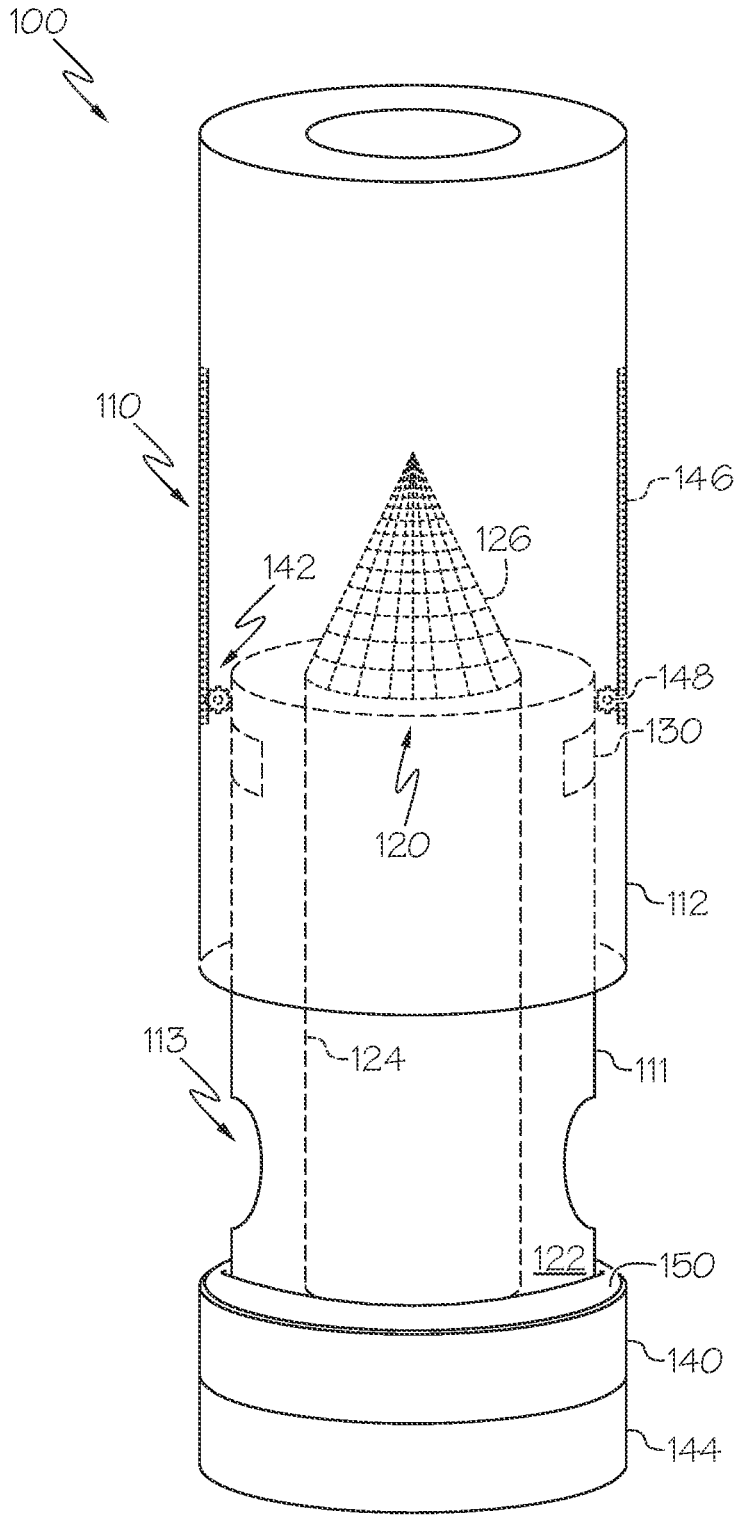
FIG. 2 schematically depicts a filter tool in a second position in accordance with one or more embodiments of the present disclosure.
Figure 3:
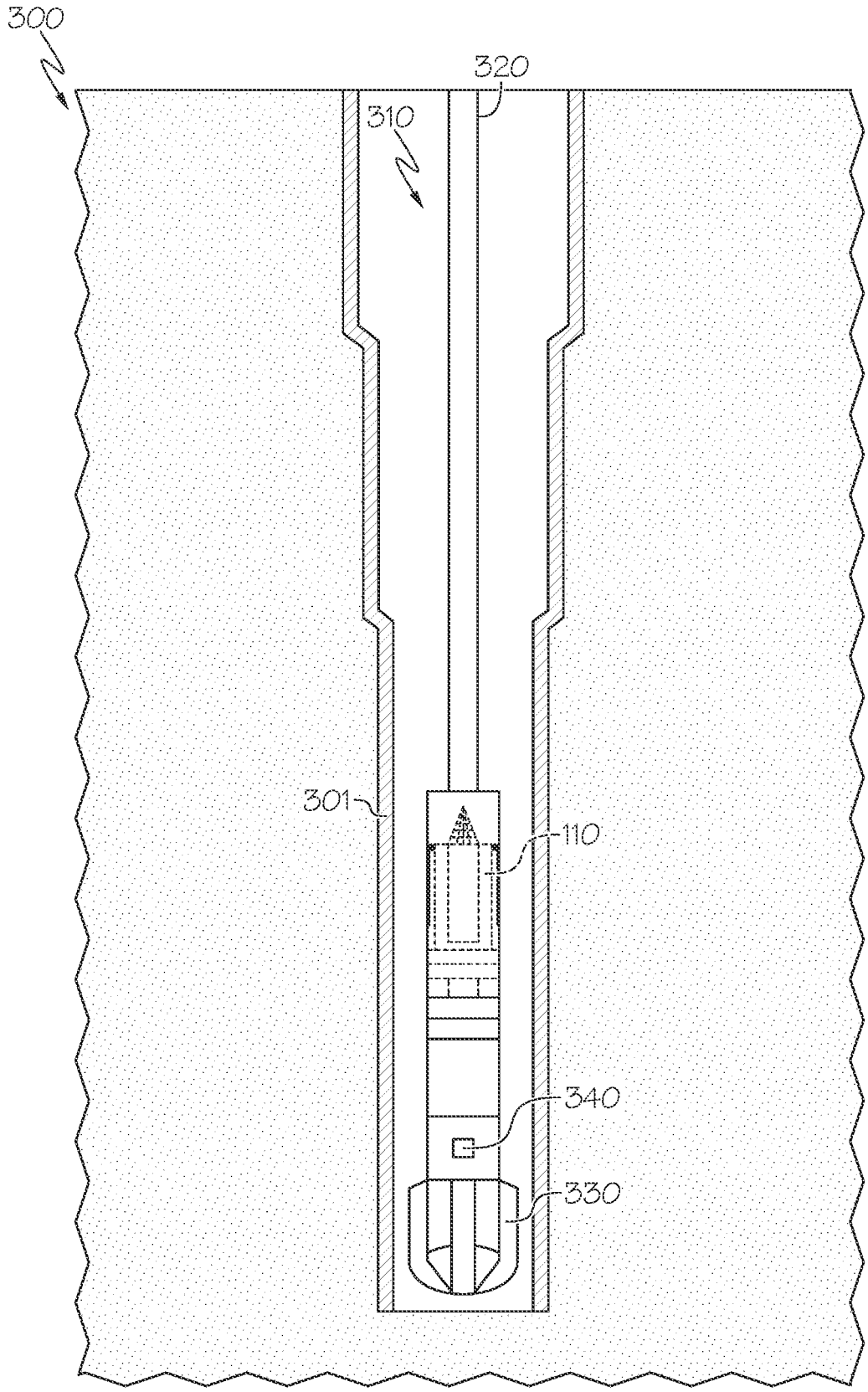
FIG. 3 schematically depicts a drilling rig and a drilling tool in accordance with one or more embodiments of the present disclosure.

Referring initially to FIGS. 1-3, a filter tool 100 for a wellbore 301 may include an outer housing 110, a filtration system 120, at least one filter tool sensor 130, and a filter motor 140. The outer housing 110 may include an interior wall 111 and an exterior wall 112. The interior wall 111 may include at least one port 113. The exterior wall 112 may define an exterior surface of the filter tool 100. The exterior wall 112 may be movable between a first position (see FIG. 1) and a second position (see FIG. 2). As shown in FIG. 1, in the first position, the exterior wall 112 may cover the at least one port 113 in the interior wall 111. As shown in FIG. 2, in the second position, the exterior wall 112 may uncover the at least one port 113 in the interior wall 111. Referring again to FIGS. 1 and 2, the interior wall 111 of the outer housing 110 and the filtration system 120 may cooperate to define a collection chamber 122. The filtration system 120 may include at least one screen 124 to allow a drilling fluid being circulated through the wellbore 301 to pass through the filter tool 100 while filtering material from the drilling fluid and collecting material in the collection chamber 122. The at least one filter tool sensor 130 may measure an amount of material collected in the collection chamber 122. The filter motor 140 may move the exterior wall 112 of the outer housing 110 between the first position and the second position.

The outer housing 110 may include the interior wall 111 and the exterior wall 112. The interior wall 111 and the exterior wall 112 may comprise the same shape or different shapes. The interior wall 111, the exterior wall 112, or both of the outer housing 110 may comprise a cylindrical shape. The interior wall 111, the exterior wall 112, or both of the outer housing 110 may comprise an outer profile that is complementary to the wellbore 301. In embodiments where the interior wall 111 and the exterior wall 112 comprise the same shape, the cross-sectional area of the interior wall 111 may be smaller than the exterior wall 112. That is, the interior wall 111 may be small enough to be disposed within the exterior wall 112.

The interior wall 111 may include at least one port 113. As used in the present disclosure, a "port" may refer to an opening for the passage of fluids and/or solids. The at least one port 113 may provide a passage from the collection chamber 122 to outside the filter tool 100. For example, the at least one port 113 may provide a passageway from the collection chamber 122 to an annular space outside the filter tool 100 when the filter tool 100 is disposed in the wellbore 301. The at least one port 113 may be positioned at a downhole end of the interior wall 111. In embodiments, the interior wall 111 may include a plurality of ports 113. The interior wall 111 may include two ports 113, three ports 113, four ports 113, five ports 113, ten ports 113, or more ports 113. The plurality of ports 113 may be spaced circumferentially around the interior wall 111, such as the downhole end of the interior wall 111. In embodiments, the plurality of ports 113 may be spaced equally circumferentially around of the interior wall 111, such as the downhole end of the interior wall 111.

Still referring to FIGS. 1 and 2, the filter tool 100 may include the filtration system 120. The filtration system 120 may include at least one screen 124 to allow a drilling fluid being circulated through the wellbore 301 to pass through the filter tool 100 while filtering material from the drilling fluid and collecting material in the collection chamber 122. The filtration system 120 may prevent material, such as debris and other undesirable solids, from passing below the filter tool. Other components downhole of the filter tool 100 may be sensitive to the material, such as debris, that is filtered by the filtration system 120 of the filter tool 100. The at least one screen 124 may comprise a mesh size that depends on chemicals used in the drilling fluid. As each drilling fluid may include different chemicals, particles in the drilling fluids may differ. One skilled in the art will appreciate that the mesh size of the at least one screen 124 may be tailored depending on the drilling fluid and/or chemicals being used. In embodiments, fine chemicals (i.e., chemicals with smaller particles) may be preferred to avoid losing communication with downhole equipment 340 (See FIG. 3).

In embodiments, the at least one screen 124 may comprise a mesh size greater than or equal to No. 10 mesh (having 0.0787 inch sieve openings) to less than or equal to 1 inch mesh (having 1 inch sieve openings), such as a mesh size greater than or equal to No. 7 mesh (having 0.111 inch sieve openings) to less than or equal to No. 3½ mesh (having 0.223 inch sieve openings). In embodiments, the filtration system 120 may include a plurality of screens 124. The plurality of screens 124 may comprise the same mesh size or different mesh sizes. For example, a first screen may be uphole of a second screen and may comprise a larger opening size (i.e., a smaller mesh size) than the second screen.

The filtration system 120 may include a mesh cone 126 at an uphole end of the filter tool 100. A downhole end of the mesh cone 126 may be in contact with an uphole end of the at least one screen 124. The mesh cone 126 may prevent material building up at an uphole end of the at least one screen 124. The angle of the mesh cone 126 may provide a smooth transition for material to be collected in the collection chamber 122. The mesh cone 126 and the at least one screen 124 may form a single screen together. Together, the mesh cone 126 and the at least one screen 124 may define an interior surface of the collection chamber 122. The mesh cone 126 may direct material to the collection chamber 122.

Still referring to FIGS. 1 and 2, the filter tool 100 may include at least one filter tool sensor 130. The at least one filter tool sensor 130 may measure a pressure in the collection chamber 122 of the filtration system 120. The at least one filter tool sensor 130 may be any conventional or yet-to-be developed sensor for measuring pressure. The at least one filter tool sensor 130 may be in communication with the filter motor 140. The at least one filter tool sensor 130 may instruct the filter motor 140 to move the exterior wall 112 of the outer housing 110 between the first position and the second position. The at least one filter tool sensor 130 may instruct the filter motor 140 to move the exterior wall 112 of the outer housing 110 between the first position and the second position. The at least one filter tool sensor 130 may instruct the filter motor 140 to move the exterior wall 112 of the outer housing 110 between the first position and the second position as the at least one filter tool sensor 130 monitors an exponential increase in pressure in the collection chamber 122. As the at least one filter tool sensor 130 monitors this exponential increase, the filter tool 100 will be trigged to move to the second position. As one skilled in the art will appreciate, the increase in pressure will depend on the hole size and the flow rate inside the filter tool 100. In embodiments, the at least one filter tool sensor may be positioned at an uphole end of the filter tool 100 or at an uphole end of the collection chamber 122.

It is contemplated that the at least one filter tool sensor 130 may be any conventional or yet-to-be developed sensor. In embodiments, the at least one filter tool sensor 130 may be a laser sensor, a pressure sensor, or a mass sensor.

In embodiments, the filter tool 100 may include a plurality of filter tool sensors 130. The plurality of filter tool sensors 130 may be positioned in various locations around the filter tool 100 or collection chamber 122 such that pressure may be measured in a plurality of locations.

The filter tool 100 may include the filter motor 140. The filter motor 140 may include a motor assembly 142 and a power supply 144. The motor assembly 142 may include at least one rail 146 and at least one gear 148. The at least one rail 146 may be connected to the exterior wall 112 of the outer housing 110 and the at least one gear 148 may be connected to the interior wall 111 of the outer housing 110. Alternatively, the at least one rail 146 may be connected to the interior wall 111 of the outer housing 110 and the at least one gear 148 may be connected to the exterior wall 112 of the outer housing 110. The at least one gear 148 may engage the at least one rail 146. The at least one gear 148 may rotate along the at least one rail 146 to move the exterior wall 112 of the outer housing 110 between the first position and the second position.

It is contemplated that the filter motor 140 may be any conventional or yet-to-be developed motor that may move the exterior wall 112 of the outer housing 110 between the first position and the second position. In embodiments, the filter motor 140 may be an electrical power motor.

Similarly, it is contemplated that the power supply 144 of the filter motor 140 may be any conventional or yet-to-be developed power supply that may power the filter motor 140. In embodiments, the filter power supply 144 will be a battery mounted near the filter motor 140, such as uphole or downhole of the filter motor 140.

Still referring to FIGS. 1-3, the filter tool 100 may include a filter tool seal 150. The filter tool seal 150 may be disposed between the exterior wall 112 of the outer housing 110 and the interior wall 111 of the outer housing 110. The filter tool seal 150 may create a fluid-tight barrier between the collection chamber 122 and the wellbore 301. As the exterior wall 112 of the outer housing 110 moves between the first position and the second position, it may be important to make sure the exterior wall 112 creates a fluid-tight seal in the first position. The filter tool seal 150 may prevent or reduce drilling fluid from escaping the filter tool 100 and not being passed through the filter tool 100 to any downhole components 340.

Referring now to FIG. 3, the present disclosure is also directed to drilling tool systems 300 for filtering a drilling fluid in a wellbore 301. A drilling tool system 300 for filtering a drilling fluid in a wellbore 301 may include a drilling tool and a filter tool. The drilling tool 310 may include a drilling fluid source (not shown), a drill string 320, and a drill bit 330. The drilling tool 310 may comprise a length of drill string 320 and the drill bit 330 may define a downhole end of the length of the drilling tool 310. The drilling source may store a drilling fluid. The drill string 320 may include a drilling tool longitudinal axial mandrel extending the length of the drill string 320. The drill string 320 may couple the drilling fluid source to the drill bit 330. The drill string 320 may transport the drilling fluid stored in the drilling fluid source along the drilling tool longitudinal axial mandrel to the drill bit 330.

The filter tool 100 employed in the systems for filtering the drilling fluid in the wellbore 301 may include any feature, function, or characteristic as previously described in the present disclosure.

The drilling fluid source may be on the surface. The drilling fluid source may include a pit or tank. One skilled in the art will appreciate alternative forms that the drilling fluid source may include. Drilling fluid may be pumped from the drilling fluid source and injected into the drill string 320 such that it is circulated through the filter tool 100 and wellbore 301.

Figure 4:
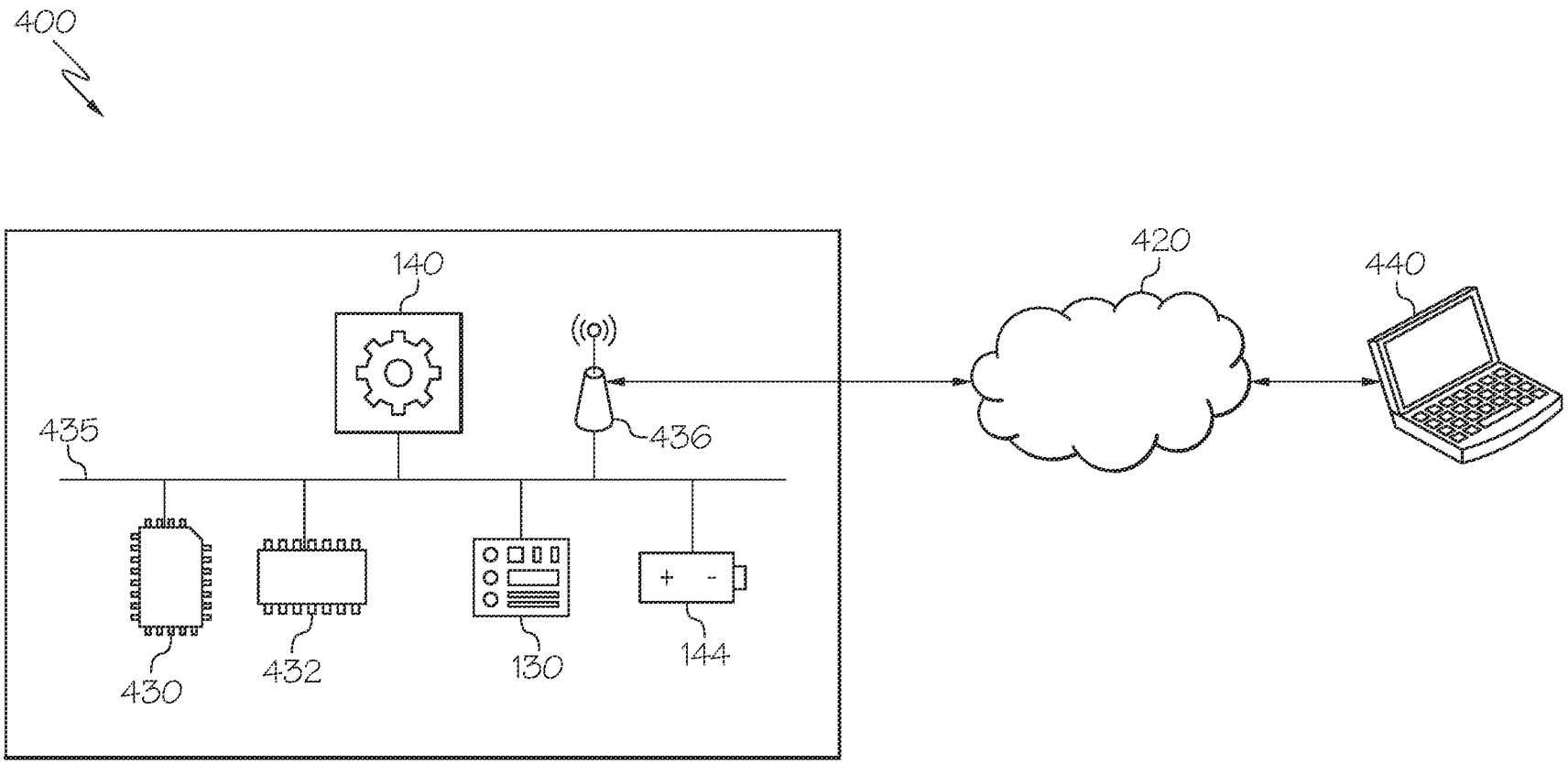
FIG. 4 schematically depicts a detection system that includes at least one filter tool sensor and a filter tool motor, according to one or more embodiments shown and described in this disclosure.

Referring now to FIG. 4, a detection system 400 may be provided for operating the filter tool 100. The detection system includes the at least one filter tool sensor 130, the filter motor 140, and the power supply 144, as well as a processor 430, a non-transitory electronic memory 432, and a communication path 435 that communicatively couples the plurality of components of the detection system 400.

In some embodiments, the processor 430 and the non-transitory electronic memory 432 and/or the other components are included within or on a single device, such as the filter tool. In other embodiments, the processor 430 and the non-transitory electronic memory 432 and/or the other components may be distributed among multiple devices that are communicatively coupled, such as various locations along the drill string. The non-transitory electronic memory 432 stores a set of machine-readable instructions. The processor 430 executes the machine-readable instructions stored in the non-transitory electronic memory 432. The non-transitory electronic memory 432 may comprise RAM, ROM, flash memories, hard drives, or any device capable of storing machine-readable instructions such that the machine-readable instructions can be accessed by the processor 430. Accordingly, the detection system 400 described herein may be implemented in any conventional computer programming language, as pre-programmed hardware elements, or as a combination of hardware and software components. The non-transitory electronic memory 432 may be implemented as one memory module or a plurality of memory modules.

In some embodiments, the non-transitory electronic memory 432 includes instructions for executing the functions of the detection system 400. The instructions may include instructions for operating the at least one filter tool sensor 130 and filter motor 140, for example, instructions regarding a pressure for the at least one filter tool sensor 130 to detect, a filter motor 140 operation routine (i.e., whether to move the exterior wall 112 from the first position to the second position and vice-versa), or any other operational instructions.

In embodiments, the non-transitory electronic memory 432 may include instructions for the at least one filter tool sensor 130 to detect a specific pressure in the filter tool. The non-transitory electronic memory 432 may include instructions for the at least one filter tool sensor 130 to detect various pressure thresholds in the filter tool. For example, if a first threshold is detected, it may be evidence that the filter tool 100 is working properly and collecting filtered material. If a second threshold, higher than the first threshold, is detected, it may be evidence that the filter tool 100 is filling up and that the collection chamber 122 of the filter tool 100 will need to be emptied soon. If a third threshold, higher than both the first and second thresholds, is detected, it may be evidence that the filter tool 100 is full and that the filter motor 140 needs to move the exterior wall 112 of the outer housing 110 between the first position and the second position. If a fourth threshold, higher than each of the first through third thresholds, is detected, it may be evidence that the filter tool 100 is completely full and that the filter tool 100 could not empty the filtered material in the collection chamber 122. In such a scenario, if the fourth threshold is reached, the filter tool 100 may need to be removed from the wellbore 301 to be checked. The non-transitory electronic memory 432 may include any other additional or alternative instructions for components of the filter tool 100 as one skilled in the art would appreciate.

The processor 430 may be any device capable of executing machine-readable instructions. For example, the processor 430 may be an integrated circuit, a microchip, a computer, or any other computing device. The non-transitory electronic memory 432 and the processor 430 are coupled to the communication path 435 that provides signal interconnectivity between various components and/or modules of the detection system 400. Accordingly, the communication path 435 may communicatively couple any number of processors with one another, and allow the modules coupled to the communication path 435 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like. As schematically depicted in FIG. 4, the communication path 435 communicatively couples the processor 430 and the non-transitory electronic memory 432 with a plurality of other components of the detection system 400.

The detection system 400 may also include network interface hardware 436 for communicatively coupling the detection system 400 to a portable device 440 via a network 420. The portable device 440 may include, without limitation, a laptop, a smartphone, a tablet, a personal media player, or any other electronic device that includes wireless communication functionality. The portable device 440 may be used to provide supplemental notification of a detected pressure in the filter tool.

The present disclosure is also directed to methods of filtering a drilling fluid in a wellbore 301. A method of filtering a drilling fluid in a wellbore 301 may include circulating a drilling fluid through a filter tool 100 in the wellbore 301. As previously described in the present disclosure, the filter tool 100 may include an outer housing 110 having an interior wall 111 comprising at least one port 113 and an exterior wall 112 defining an exterior surface of the filter tool. The exterior wall 112 may be movable between a first position in which the exterior wall 112 covers the at least one port 113 in the interior wall 111 and a second position in which the exterior wall 112 uncovers the at least one port 113 in the interior wall 111. The method may further include passing at least a portion of the drilling fluid through a filtration system 120 of the filter tool 100. Also, as previously described in the present disclosure, the interior wall 111 of the outer housing 110 and the filtration system 120 may cooperate to define a collection chamber 122. The filtration system 120 may include at least one screen 124 to allow the drilling fluid to pass through the filter tool 100 while filtering material from the drilling fluid and collecting material in the collection chamber 122. The method may further include measuring an amount of material collected in the collection chamber 122 of the filter tool 100, moving the exterior wall 112 of the outer housing 110 of the filter tool 100 from the first position to the second position to uncover the at least one port 113 of the interior wall 111 of the outer housing 110, at least partially passing material collected in the collection chamber 122 to the wellbore 301.

The filter tool 100 employed in the methods of filtering the drilling fluid in the wellbore 301 may include any feature, function, or characteristic as previously described in the present disclosure.

Measuring the amount of material collected in the collection chamber 122 may comprise monitoring the pressure in the filter tool 100. When a predetermined pressure is measured in the collection chamber 122, the exterior wall 112 of the outer housing 110 may be moved from the first position to the second position.

The method of filtering the drilling fluid in the wellbore 301 may be continuous. That is, the filtering of the drilling fluid in the wellbore 301 may not include or require removing the filter tool 100 from the wellbore 301. In conventional filter tools, the collection chamber may not be able to be flushed or emptied while the conventional filter tool is in the wellbore. Removing conventional filter tools from the wellbore to empty the collection chamber may require significant time to remove the conventional filter tool from the wellbore and to empty the collection chamber of the conventional filter tool. Conversely, the filter tools 100 of the present disclosure can be operated on a continuous basis, continuously filtering drilling fluid in a wellbore 301 without the need to be removed. The filter tools 100 of the present disclosure provide a desired advantage over conventional filter tools.

One or more aspects of the present disclosure are described herein. A first aspect may include a filter tool for a wellbore. The filter tool may include an outer housing, a filtration system, at least one filter tool sensor, and a filter motor. The outer housing may have an interior wall comprising at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The interior wall of the outer housing and the filtration system may cooperate to define a collection chamber, the filtration system may include at least one screen to allow a drilling fluid being circulated through the wellbore to pass through the filter tool while filtering material from the drilling fluid and collecting material in the collection chamber. The at least one filter tool sensor may measure an amount of material collected in the collection chamber. The filter motor may move the exterior wall of the outer housing between the first position and the second position.

A second aspect of the present disclosure may include the first aspect, wherein the interior wall, the exterior wall, or both of the outer housing comprise a cylindrical shape.

A third aspect of the present disclosure may include either the first or second aspect, wherein the interior wall, the exterior wall, or both of the outer housing comprise an outer profile that is complementary to the wellbore.

A fourth aspect of the present disclosure may include any one of the first through third aspects, wherein the at least one port is positioned at a downhole end of the interior wall.

A fifth aspect of the present disclosure may include any one of the first through fourth aspects, wherein the interior wall comprises a plurality of ports.

A sixth aspect of the present disclosure may include the fifth aspect, wherein the plurality of ports are spaced circumferentially around the interior wall.

A seventh aspect of the present disclosure may include any one of the first through sixth aspects, wherein the at least one screen comprises a mesh size greater than or equal to No. 10 mesh (having 0.0787 inch sieve openings) to less than or equal to 1 inch mesh (having 1 inch sieve openings).

An eighth aspect of the present disclosure may include any one of the first through seventh aspects, wherein the filtration system further comprises a mesh cone at an uphole end of the filter tool operable to direct material to the collection chamber.

A ninth aspect of the present disclosure may include the eighth aspect, wherein a downhole end of the mesh cone is in contact with an uphole end of the at least one screen.

A tenth aspect of the present disclosure may include any one of the first through ninth aspects, wherein the at least one filter tool sensor is positioned at an uphole end of the filter tool or at an uphole end of the collection chamber.

An eleventh aspect of the present disclosure may include any one of the first through tenth aspects, wherein the at least one filter tool sensor is operable to measure a pressure in the collection chamber of the filtration system.

A twelfth aspect of the present disclosure may include any one of the first through eleventh aspects, wherein the at least one filter tool sensor is in communication with the filter motor and is operable to instruct the filter motor to move the exterior wall of the outer housing between the first position and the second position.

A thirteenth aspect of the present disclosure may include the twelfth aspect, wherein the at least one filter tool sensor is operable to instruct the filter motor to move the exterior wall of the outer housing between the first position and the second position A fourteenth aspect of the present disclosure may include any one of the first through thirteenth aspects, wherein the filter motor comprises a motor assembly and a power supply, the motor assembly comprising at least one rail and at least one gear, wherein the at least one rail is connected to the exterior wall of the outer housing and the at least one gear is connected to the interior wall of the outer housing.

A fifteenth aspect of the present disclosure may include the fourteenth aspect, wherein the at least one gear engages the at least one rail and is operable to rotate along the at least one rail to move the exterior wall of the outer housing between the first position and the second position.

A sixteenth aspect of the present disclosure may include either the fourteenth or fifteenth aspect, wherein the power supply comprises a battery.

A seventeenth aspect of the present disclosure may include any one of the first through sixteenth aspects, wherein the filter tool further comprises a filter tool seal between the exterior wall of the outer housing and the interior wall of the outer housing.

An eighteenth aspect of the present disclosure may include the seventeenth aspect, wherein the filter tool seal is operable to create a fluid-tight barrier between the collection chamber and the wellbore.

A nineteenth aspect of the present disclosure may include a system for filtering a drilling fluid in a wellbore. The system may include a drilling tool and a filter tool. The drilling tool may include a drilling fluid source, a drill string, and a drill bit. The drilling tool may comprise a length and the drill bit may define a downhole end of the length of the drilling tool. The drilling fluid source may be operable to store a drilling fluid. The drill string may comprise a drilling tool longitudinal axial mandrel extending the length of the drill string. The drill string may couple the drilling fluid source to the drill bit and may transport the drilling fluid stored in the drilling fluid source along the drilling tool longitudinal axial mandrel to the drill bit. The filter tool may include an outer housing, a filtration system, at least one filter tool sensor, and a filter tool motor. The outer housing may include an interior wall having at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The interior wall of the outer housing and the filtration system may cooperate to define a collection chamber. The filtration system may include at least one screen to allow a drilling fluid to pass through the filter tool while filtering material from the drilling fluid and collecting material in the collection chamber. The at least one filter tool sensor may measure the amount of material collected in the collection chamber. The filter motor may move the exterior wall of the outer housing between the first position and the second position. The filter tool may be positioned along the drill string and above the drill bit. The drilling tool longitudinal axial mandrel may be in fluid communication with the filter tool.

A twentieth aspect of the present disclosure may include a method of filtering a drilling fluid in a wellbore. The method may include circulating a drilling fluid through a filter tool in the wellbore. The filter tool may include an outer housing having an interior wall comprising at least one port and an exterior wall defining an exterior surface of the filter tool. The exterior wall may be movable between a first position in which the exterior wall covers the at least one port in the interior wall and a second position in which the exterior wall uncovers the at least one port in the interior wall. The method may also include passing at least a portion of the drilling fluid through a filtration system of the filter tool. The interior wall of the outer housing and the filtration system may cooperate to define a collection chamber. The filtration system may include at least one screen to allow the drilling fluid to pass through the filter tool while filtering material from the drilling fluid and collecting material in the collection chamber. The method may also include measuring an amount of material collected in the collection chamber, moving the exterior wall of the outer housing of the filter tool from the first position to the second position to uncover the at least one port of the interior wall of the housing, and at least partially passing material collected in the collection chamber to the wellbore.

It is also noted that recitations herein of "a plurality" of any one component, element, etc., should not be used to create an inference that the alternative use of the articles "a" or "an" should be limited to a single component, element, etc.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A filter tool for a wellbore, the filter tool comprising:

an outer housing having an interior wall comprising at least one port and an exterior wall defining an exterior surface of the filter tool, the exterior wall being movable between a first position in which the exterior wall covers the at least one port in the interior wall and a second position in which the exterior wall uncovers the at least one port in the interior wall;

a filtration system, the interior wall of the outer housing and the filtration system cooperating to define a collection chamber, the filtration system comprising at least one screen to allow a drilling fluid being circulated through the wellbore to pass through the filter tool while filtering material from the drilling fluid and collecting material in the collection chamber;

at least one filter tool sensor operable to measure an amount of material collected in the collection chamber; and a filter motor operable to move the exterior wall of the outer housing between the first position and the second position.

2. The filter tool of claim 1, wherein the interior wall, the exterior wall, or both of the outer housing comprise a cylindrical shape.

3. The filter tool of claim 1, wherein the interior wall, the exterior wall, or both of the outer housing comprise an outer profile that is complementary to the wellbore.

4. The filter tool of claim 1, wherein the at least one port is positioned at a downhole end of the interior wall.

5. The filter tool of claim 1, wherein the interior wall comprises a plurality of ports.

6. The filter tool of claim 5, wherein the plurality of ports are spaced circumferentially around the interior wall.

7. The filter tool of claim 1, wherein the at least one screen comprises a mesh size greater than or equal to No. 10 mesh (having 0.0787 inch sieve openings) to less than or equal to 1 inch mesh (having 1 inch sieve openings).

8. The filter tool of claim 1, wherein the filtration system further comprises a mesh cone at an uphole end of the filter tool operable to direct material to the collection chamber.

9. The filter tool of claim 8, wherein a downhole end of the mesh cone is in contact with an uphole end of the at least one screen.

10. The filter tool of claim 1, wherein the at least one filter tool sensor is positioned at an uphole end of the filter tool or at an uphole end of the collection chamber.

11. The filter tool of claim 1, wherein the at least one filter tool sensor is operable to measure a pressure in the collection chamber of the filtration system.

12. The filter tool of claim 1, wherein the at least one filter tool sensor is in communication with the filter motor and is operable to instruct the filter motor to move the exterior wall of the outer housing between the first position and the second position.

13. The filter tool of claim 12, wherein the at least one filter tool sensor is operable to instruct the filter motor to move the exterior wall of the outer housing between the first position and the second position.

14. The filter tool of claim 1, wherein the filter motor comprises a motor assembly and a power supply, the motor assembly comprising at least one rail and at least one gear, wherein the at least one rail is connected to the exterior wall of the outer housing and the at least one gear is connected to the interior wall of the outer housing.

15. The filter tool of claim 14, wherein the at least one gear engages the at least one rail and is operable to rotate along the at least one rail to move the exterior wall of the outer housing between the first position and the second position.

16. The filter tool of claim 14, wherein the power supply comprises a battery.

17. The filter tool of claim 1, wherein the filter tool further comprises a filter tool seal between the exterior wall of the outer housing and the interior wall of the outer housing.

18. The filter tool of claim 17, wherein the filter tool seal is operable to create a fluid-tight barrier between the collection chamber and the wellbore.

19. A drilling tool system for filtering a drilling fluid in a wellbore, the system comprising a drilling tool and a filter tool, wherein:

the drilling tool comprises a drilling fluid source, a drill string, and a drill bit, the drilling tool comprises a length and the drill bit defines a downhole end of the length of the drilling tool;

the drilling fluid source is operable to store a drilling fluid;

the drill string comprises a drilling tool longitudinal axial mandrel extending the length of the drill string;

the drill string couples the drilling fluid source to the drill bit and is operable to transport the drilling fluid stored in the drilling fluid source along the drilling tool longitudinal axial mandrel to the drill bit;

the filter tool comprises an outer housing, a filtration system, at least one filter tool sensor, and a filter tool motor, wherein the outer housing comprises an interior wall having at least one port and an exterior wall defining an exterior surface of the filter tool, the exterior wall being movable between a first position in which the exterior wall covers the at least one port in the interior wall and a second position in which the exterior wall uncovers the at least one port in the interior wall;

the interior wall of the outer housing and the filtration system cooperate to define a collection chamber, the filtration system comprises at least one screen to allow the drilling fluid to pass through the filter tool while filtering material from the drilling fluid and collecting material in the collection chamber;

the at least one filter tool sensor being operable to measure the amount of material collected in the collection chamber; and the filter tool motor being operable to move the exterior wall of the outer housing between the first position and the second position;

the filter tool is positioned along the drill string and above the drill bit; and the drilling tool longitudinal axial mandrel is in fluid communication with the filter tool.

20. A method of filtering a drilling fluid in a wellbore, the method comprising:

circulating a drilling fluid through a filter tool in the wellbore, the filter tool comprising an outer housing having an interior wall comprising at least one port and an exterior wall defining an exterior surface of the filter tool, the exterior wall being movable between a first position in which the exterior wall covers the at least one port in the interior wall and a second position in which the exterior wall uncovers the at least one port in the interior wall;

passing at least a portion of the drilling fluid through a filtration system of the filter tool, the interior wall of the outer housing and the filtration system cooperating to define a collection chamber, the filtration system comprising at least one screen to allow the drilling fluid to pass through the filter tool while filtering material from the drilling fluid and collecting material in the collection chamber;

measuring an amount of material collected in the collection chamber;

moving the exterior wall of the outer housing of the filter tool from the first position to the second position to uncover the at least one port of the interior wall of the housing; and at least partially passing material collected in the collection chamber to the wellbore.

* * * * *